US005319381A

United States Patent [19]

Mourey et al.

[11] Patent Number: 5,319,381

[45] Date of Patent: Jun. 7, 1994

[54] METHOD FOR ADDRESSING EACH COLUMN OF A MATRIX TYPE LCD PANEL

[75] Inventors: Bruno Mourey, Palaiseau, France; Eric Benoit, VS-Schwenningen; Antoine Dupont, VS-Villingen, both of Fed. Rep. of Germany

[73] Assignee: Thomson Consumer Electronics, Courbevoie, France

[21] Appl. No.: 47,360

[22] Filed: Apr. 19, 1993

Related U.S. Application Data

[63] Continuation of Ser. No. 630,193, Dec. 19, 1990, abandoned.

[30] Foreign Application Priority Data

Dec. 28, 1989 [FR] France ..... 89 17312

[51] Int. Cl.[5] ..... G09G 3/36

[52] U.S. Cl. ..... 345/100; 345/92; 348/792

[58] Field of Search ..... 340/784, 765, 811, 805; 358/241, 236; 359/54, 55, 57, 58, 59, 84, 85; 345/87, 92, 94, 96, 98, 99, 100

[56] References Cited

U.S. PATENT DOCUMENTS

| | | | |
|---|---|---|---|
| 4,525,710 | 6/1985 | Hoshi et al. . | |
| 4,591,848 | 5/1986 | Morozumi et al. | 340/805 |
| 4,635,127 | 1/1987 | Togashi | 358/236 |
| 4,710,768 | 12/1987 | Takeda et al. | 340/784 |
| 4,734,692 | 3/1988 | Hosono et al. | 340/784 |
| 4,795,239 | 1/1989 | Yamashita et al. | 340/784 |
| 4,917,470 | 4/1990 | Okada et al. | 340/805 |
| 5,018,841 | 5/1991 | Mouri et al. | 340/805 |

FOREIGN PATENT DOCUMENTS

| | | |
|---|---|---|
| 199361 | 10/1986 | European Pat. Off. . |
| 298255 | 1/1989 | European Pat. Off. . |
| 2135099 | 8/1984 | United Kingdom . |
| 2204174 | 11/1988 | United Kingdom . |

*Primary Examiner*—Alvin E. Oberley
*Assistant Examiner*—Xiao M. Wu
*Attorney, Agent, or Firm*—Oblon, Spivak, McClelland, Maier & Neustadt

[57] ABSTRACT

Disclosed is a method for the addressing of each column of a matrix type LCD panel consisting in the production of a pulse to control a driver transistor of said column, said pulse having a duration determined by the value of the video signal sample at input, said pulse acting on the conduction state of said transistor to connect said column to a supply terminal where a voltage gradient develops. According to the method two pulse durations, the sum of which is predetermined, are alternated and, in order that a given value of a video signal sample may produce the same optical effect from one period to the next one, differentiated excitation voltages are applied to at least one of the electrodes sandwiching the liquid crystal layer, namely said column and its counter-electrode. Application notably to active matrix LCD panels.

7 Claims, 3 Drawing Sheets

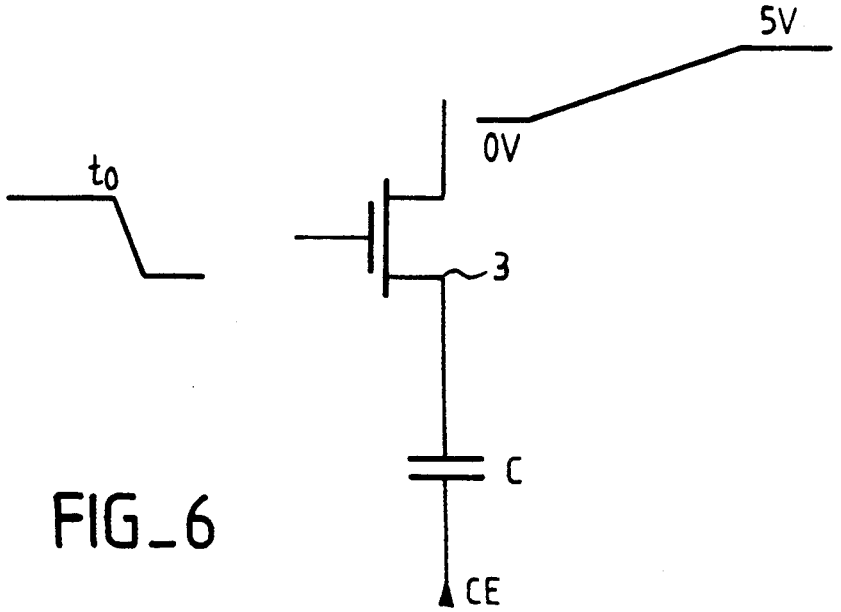
FIG_6
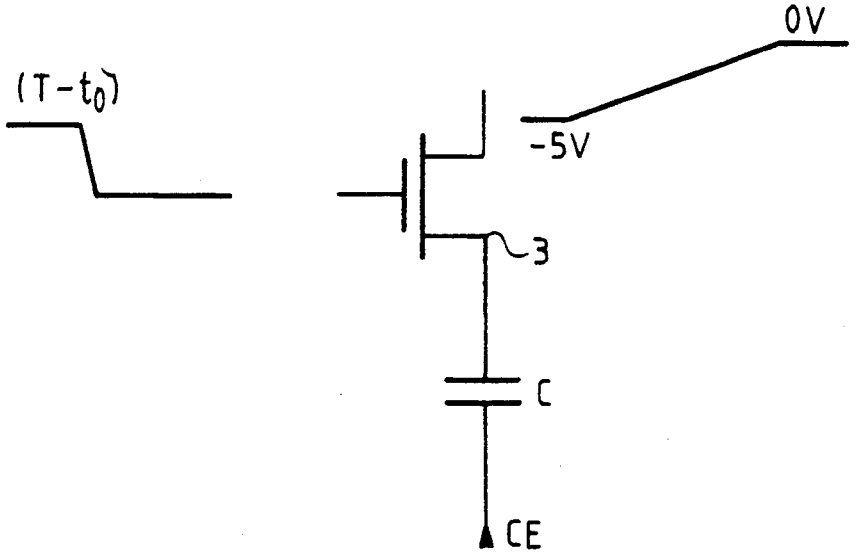
FIG_3
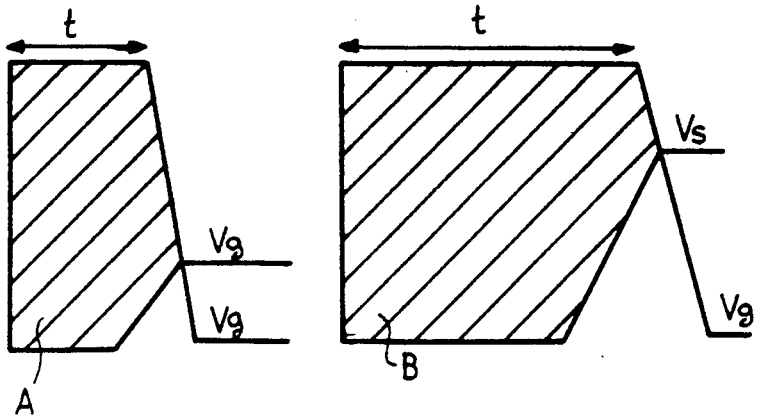

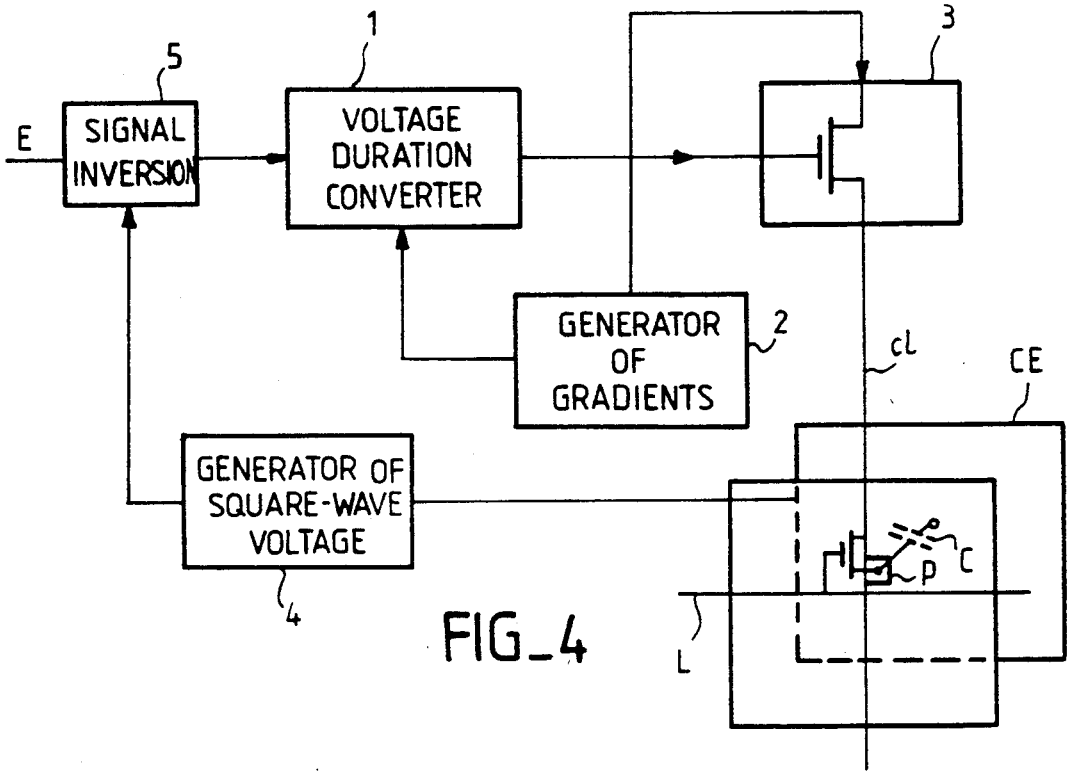
FIG_4
FIG_5
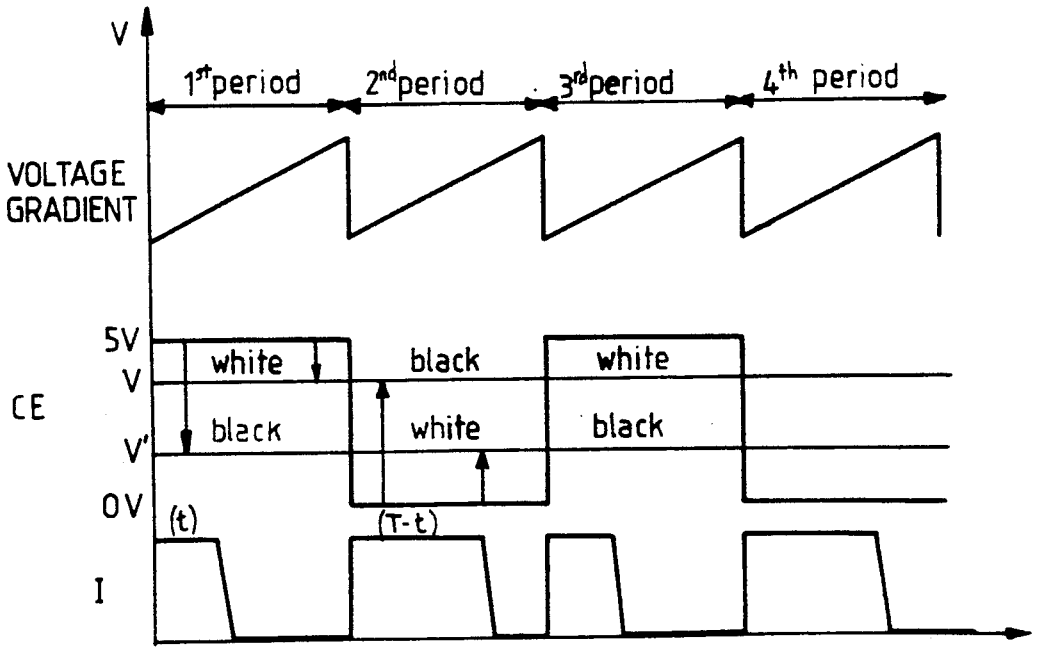

METHOD FOR ADDRESSING EACH COLUMN OF A MATRIX TYPE LCD PANEL

This application is a continuation of application Ser. No. 07/630,193, filed on Dec. 19, 1990, now abandoned.

BACKGROUND OF THE INVENTION

1. Field of the Invention

The present invention concerns the control of the columns of a matrix type LCD panel, especially a method for addressing each column of an LCD panel, and notably an active matrix LCD panel.

2. Description of the Prior Art

A matrix type LCD panel has a set of line buses and column buses which control the voltage applied t electrodes located on one and the same side of a layer of liquid crystal, the other side being occupied by a counter-electrode which cooperates with the first electrode to electrically orient the molecules of the liquid crystal and achieve the modulation of a light beam by rotation of polarization. The columns are controlled by giving each column a current for charging the capacitor set up between the column conductor and the counter-electrode in such a way that the voltage at the terminals of this capacitor represents a video signal sample between two successive addressing operations.

To obtain this charge current as a function of the video signal, it is proposed, notably when the control circuits are integrated into the LCD panel, to use a column driver transistor, the gate of which receives a control pulse as a function of the video signal sample. To illustrate this case, FIG. 1 shows the schematic diagram of a known control for an active matrix LCD panel symbolized by a column cl, a line L, a picture element P, the counter-electrode CE and a line selection thin-film transistor.

More specifically, it has been proposed, as shown in FIG. 1, to use a column control circuit comprising a voltage-duration converter 1 which receives the video signal sample E at one of its inputs and a voltage gradient coming from a gradient, generator 2 at its other input. At output, this converter delivers a pulse I, the duration t of which expresses the amplitude of the video signal sample at input. This pulse I is sent to the gate g of a driver field-effect transistor 3. One of the electrodes, or drain d in the embodiment shown, of this field-effect transistor 3 receives a voltage gradient coming from the generator 2. Its other electrode, or source S, is connected to the column bus considered. With the above-described circuit, so long as the voltage Vgs of the transistor 3 remains greater than its threshold voltage Vt, the signal on the source s follows the changes in the voltage gradient applied to the drain d, and the capacitor C, which represents the equivalent capacitance of the column, namely the liquid crystal capacitance, the unwanted capacitances of the picture element P control transistors and the intersection capacitance of the buses, gets charged. As soon as the voltage Vgs becomes smaller than the threshold voltage Vt, the transistor 3 goes off and the signal at the column keeps, as its value, the value of the voltage charged in the capacitor C. Thus, at each column cl, there is obtained a voltage which is, for example, proportional to the width of the control pulse I of the transistor 3.

In this circuit, the pulse I obtained at output of the converter 1 does not have a steep-sloped descending edge The result thereof is that the transistor 3 goes off at an instant depending on the value of the conduction threshold. Consequently, the capacitor charging voltage changes with the shifting of the threshold. Indeed, the conduction threshold gets shifted through the electrical stress undergone by the field-effect transistor 3 used to switch-over the column. This stress may be defined as the product of the gate-source voltage by the duration in which the voltage is applied. Thus, this stress is a function of the value of the input signal and, hence, of the video signal since the duration of the pulse is a function of the video signal. To illustrate this problem, FIG. 2 shows the pulse I, the voltage gradient and the column voltages V1 and V2 obtained respectively with threshold voltages T1 and T2. It is seen that the raising of the threshold voltage of the transistor tends to reduce the column voltage Vsg. Thus, it can be seen that a low value of the video signal sample generates a gate-source voltage stress which is smaller than the stress generated by a high value of the video signal sample, as shown schematically by A and B in FIG. 3. In the former case, the shift in the threshold voltage will therefore be smaller. The result thereof is a non-uniform shift in the threshold voltages of the different column switch-over transistors, leading to a non-uniformity of luminance on the LCD panel.

The present invention, therefore, is aimed at overcoming this drawback by proposing a method for the addressing of each column that prevents the switch-over threshold of the transistor from changing with the video signal samples.

The present invention is also aimed at proposing a method for the addressing of each column that enables the creation of conditions such that the gate-source stress of the transistor is, on an average, independent of the video signal sample applied to the column.

SUMMARY OF THE INVENTION

Consequently, the present invention is also aimed at proposing a method for the addressing of each column of a matrix type LCD panel consisting in the production of a pulse to control a driver transistor of said column, said pulse having a duration determined by the value of the video signal sample at input, said pulse acting on the conduction state of said transistor to connect said column to a supply terminal where a voltage gradient develops, wherein two pulse durations, the sum of which is predetermined, are alternated and wherein, in order that a given value of a video signal sample may produce the same optical effect from one period to the next one, differentiated excitation voltages are applied to at least one of the electrodes sandwiching the liquid crystal layer, namely said column and its counter-electrode.

According to a particular embodiment, before conversion, the video signal is inverted periodically so that, after conversion, there is obtained a pulse with a duration t during a first period and a pulse with a duration T-t during a second period, T being the duration of the period.

Furthermore, when an AC voltage is applied periodically to the counter-electrode, the same voltage gradient is applied at each period.

However, when a fixed voltage is applied to the counter-electrode, the voltage gradient is shifted symmetrically at each period in relation to the fixed voltage so that a gradient varying between V and V' is applied during a first period and a gradient varying between −V' and −V is applied during a second period.

With this method, the mean value of the gate-source stresses is constant. Thus, the shift in the threshold voltages of the transistors controlling the columns is also constant, and this results in a uniform visual degradation.

However, according to another characteristic of the invention, to overcome this constant shift from the normal of the voltages on the columns, a DC shift voltage, compensating for the mean shift in the threshold voltages of the switch-over transistors, is applied to the counter-electrode.

BACKGROUND OF THE INVENTION

Other features and advantages of the present invention shall appear from the following description of different embodiments, said description being made with reference to the appended drawings, in which:

FIG. 1, already described, is a block diagram of a control circuit of a column of a prior art active matrix LCD panel;

FIG. 3 represents two schematic curves showing the stress as a function of the voltage of the video sample;

FIG. 4 is a block diagram of a control circuit for the implementation of the method of the present invention when the AC voltage is applied to the counter-electrode;

FIG. 5 is a timing diagram explaining the working of the present invention, and

FIG. 6 is a simplified diagram explaining the working of the present invention in the case of an active matrix LCD panel, the counter-electrode of which is at a fixed potential.

To simplify the description, the same references are repeated for the same elements in the figures.

DESCRIPTION OF PREFERRED EMBODIMENTS

Figure 1:
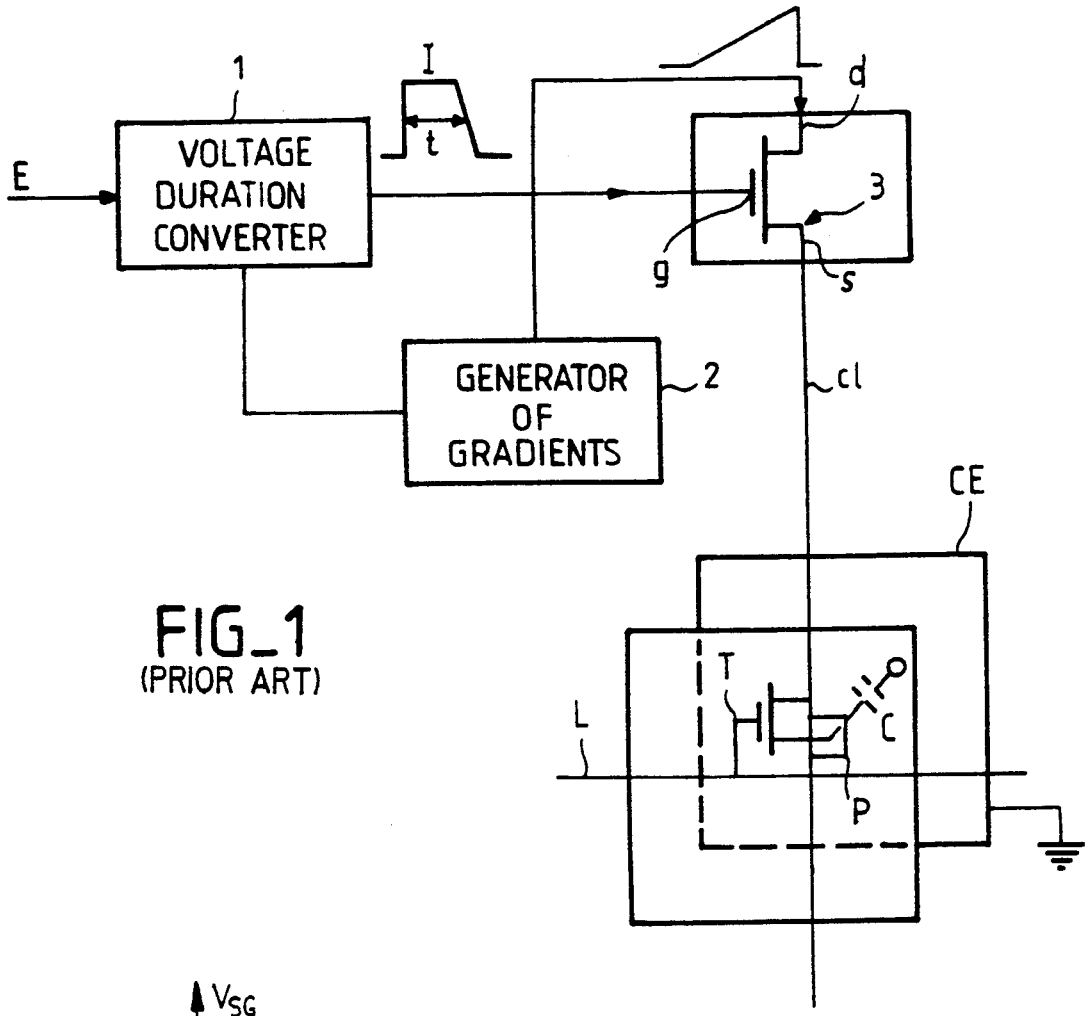
FIG 1 (PRIOR ART)
Figure 2:
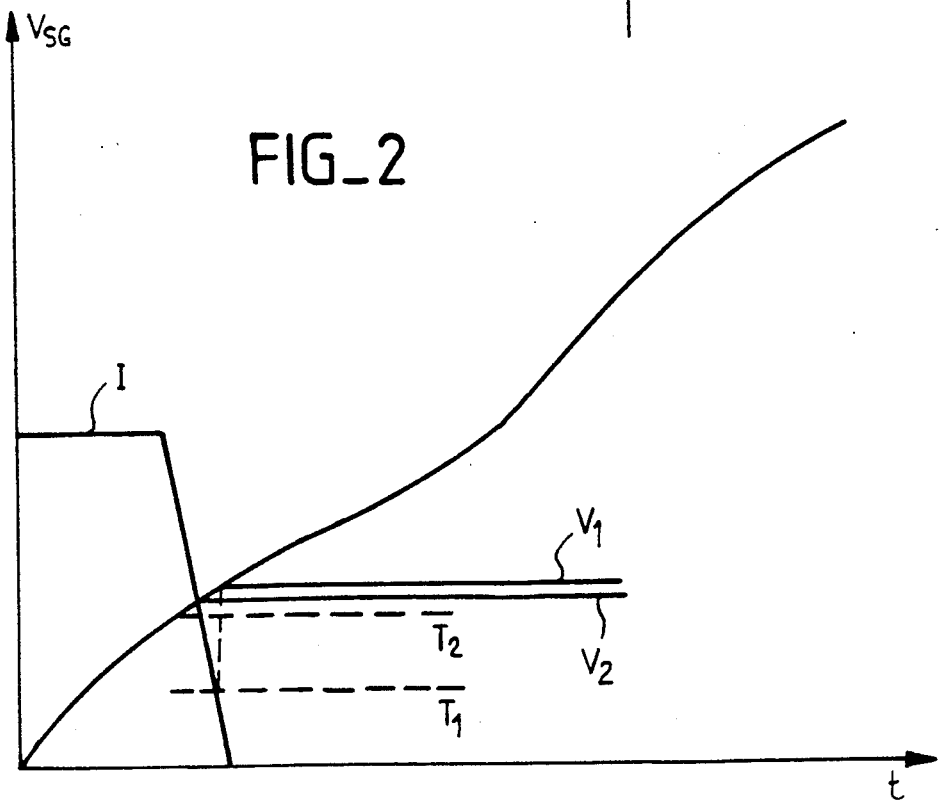
FIG. 2 is a curve giving the voltage as a function of time, explaining the problems due to the stress of the switch-over transistor in the circuit of FIG. 1.

FIG. 4 shows an active matrix LCD panel. This panel has been represented schematically by a single picture element or pixel P at the intersection between a column bus cl and a line bus L. In the embodiment shown, the line L/column c1 coupling is achieved by a thin-film transistor (TFT) T which receives, at its gate, the voltage applied to the line L and, at an electrode, the voltage applied to the column. The other electrode is connected to the electrode of the liquid crystal forming the capacitor C with the counter-electrode CE. The liquid crystal is therefore equivalent to a capacitor C with a resistor (not shown). In the embodiment of FIG. 4, the counter-electrode CE receives an AC voltage coming from a square-wave voltage generator 4. As shown in FIG. 5, the voltage of the counter-electrode CE goes alternately to a level, for example, of five volts for a first period and then to a level of, for example, 0 volt for a second period. Moreover, like the column control circuit of FIG. 1, the column control circuit includes a voltage-duration converter 1 which receives a video signal sample at input and, at another input, a gradient coming from a gradient generator 2. In accordance with the present invention, the video signal sample E comes from a circuit 5 that complements the video signal. The circuit 5 is commanded by the square-wave voltage generator 4 so as to apply the video signal itself during a first period and the complement of the video signal during a second period. Thus, at output of the voltage-duration converter 1, a pulse I is obtained, the duration of which is a function of the amplitude of the video signal, namely a pulse I having, for example, a duration t during the first period and a duration T−t during the second period, T representing the duration of the period, i.e. preferably a frame duration. More generally, the alternation of the two pulse durations is equal to a predetermined sum.

With the above circuit, when the pulse has a duration t, a voltage V' as shown in FIG. 5 is obtained at the source s of the transistor 3. In this case, the voltage at the terminals of the liquid crystal cell is equal to (5 volts−V') in the embodiment shown and corresponds to a high voltage enabling, for example, the display of the black. During the second period, the pulse I has a duration T−t and corresponds to a voltage V on the source. In this case, the voltage at the terminals of the liquid crystal cell becomes equal to 0−V: this voltage is also a high voltage corresponding to the display of the black. As shown in FIG. 5, the square-wave voltage between 0 and 5 V as well as the voltages V and V' are chosen in such a way that (5−V')=(V−0). A null mean voltage is therefore applied to the terminals of the liquid crystal cell. The same conclusions would be obtained for the display of the white or gray levels.

In practice, the threshold voltages of the control transistors of the different lines undergo a shift such that the voltages corresponding respectively to the white and black levels are no longer V and V'but generally V−DV and V'−DV. To overcome these shifts in voltages at the picture element, according to the present invention a shift voltage of the same level is applied to the counter-electrode. However, this compensation can also be achieved at other places, notably by decoding the gradient, or at the video signal itself.

Referring to FIG. 6, we shall now describe an embodiment of the addressing method according to the present invention when the counter-electrode CE receives a fixed voltage, for example a voltage of 0 volts. In accordance with the present invention, in this case, not only is the video signal E alternately transmitted or complemented at each period, but the gradient applied to one of the electrodes of the switch-over transistor is shifted in voltage at each period. Thus, we apply either a gradient varying, for example between 0 and 5 volts during a first period or a gradient varying between −5 volts and 0 volt during a second period, as shown in FIG. 5 which concerns an example of the encoding of a black picture element. In the embodiment shown, the pulse applied to the gate of the transistor 3 has a duration which corresponds to a maximum stress. The voltage at the terminals of the pixel P is therefore equal to 5 volts (maximum value of the gradient) −0 volt (voltage applied to the counter-electrode) giving 5 volts which corresponds to a minimum luminance of the picture element. During the second period, the pulse applied to the gate of the transistor 3 has a duration T−to corresponding to a minimum stress. The voltage at the terminals of the pixel is equal to −5 volts (minimum value of the gradient) −0 volts (value of the voltage of the counter-electrode) giving −5 volts. The luminance of the picture element is again the minimum in this case. Thus, in matching the variations in voltage of the gradient applied to the electrode of the transistor 3, it is possible to make the stress applied to all the transistors of the control circuit uniform by reversing the video signal from one period to another.

The two embodiments described above have been given by way of example and are not restrictive as regards the scope of the claims.

What is claimed is:

1. A method for the addressing of each column of a matrix type LCD panel consisting in the production of a pulse segment as a function of a video signal wherein said pulse segment functions to control a driver transistor of said column, said pulse segment having a duration determined by the value of an input video signal sample, said pulse segment acting on said transistor to cause said transistor to conduct in order to connect said column to a voltage gradient supply terminal, wherein said pulse segment includes two pulse durations, the sum of which is a frame duration, and said two pulse segments are alternated and wherein, in order that a given value of a video signal sample may produce the same optical effect from one period to the next one, differentiated excitation voltages are applied to at least one of two electrodes sandwiching the crystal layer, said crystal layer and said electrodes including said column and its counter-electrode.

2. An addressing method according to claim 1 wherein, before conversion, the video signal is inverted periodically so that, after conversion, there is obtained a pulse with a duration t during a first period and a pulse with a duration T−t during a second period, T being the duration of the period.

3. A method according to claim 1 wherein, when an AC voltage is applied periodically to the counter-electrode, the same voltage gradient is applied at each period.

4. A method according to claim 1 wherein, when a fixed voltage is applied to the counter-electrode, the voltage gradient is shifted symmetrically at each period in relation to the fixed voltage so that a gradient varying between V and V′ is applied during a first period and a gradient varying between −V′ and −V is applied during a second period.

5. A method according to claim 2, wherein the period T corresponds to a frame.

6. A method according to claim 1, wherein the LCD panel is an active matrix panel.

7. A method according to claim 1, wherein a DC shift voltage, compensating for the mean shift in the threshold voltages of the switch-over transistors, is applied to the counter-electrode.

* * * * *